United States Patent [19]

Randy

[11] Patent Number: 4,927,020

[45] Date of Patent: May 22, 1990

[54] HOLDER FOR SOCKET WRENCH HEADS

[76] Inventor: Frank Randy, 5 N. Greenwood Ave., New Castle, Pa. 16101

[21] Appl. No.: 322,359

[22] Filed: Mar. 13, 1989

[51] Int. Cl.[5] ..... B65D 85/20

[52] U.S. Cl. ..... 206/378; 206/565; 248/225.1

[58] Field of Search ..... 206/372, 376, 378, 565, 206/493, 373, 374, 375; 211/70.6; 248/223.4, 225.1; 403/381, 375

[56] References Cited

U.S. PATENT DOCUMENTS

| | | | |
|---|---|---|---|
| 1,712,473 | 8/1927 | McWethy | 206/378 |
| 2,754,974 | 7/1956 | Larson | 211/70.6 |
| 3,726,393 | 4/1973 | Thompson | 206/378 |
| 4,174,037 | 11/1979 | Chow | 206/378 |
| 4,337,860 | 7/1982 | Carrigan | 206/378 |
| 4,589,557 | 5/1986 | Bollmann | 248/225.1 |
| 4,635,801 | 1/1987 | Oren | 211/70.6 |
| 4,717,106 | 1/1988 | Bies et al. | 211/70.6 |
| 4,826,021 | 5/1989 | Burrell | 211/70.6 |

FOREIGN PATENT DOCUMENTS

| | | | |
|---|---|---|---|
| 2703367 | 8/1978 | Fed. Rep. of Germany | 206/373 |
| 1359150 | 7/1974 | United Kingdom | 248/223.4 |

*Primary Examiner*—William Price
*Assistant Examiner*—Jacob K. Ackun, Jr.
*Attorney, Agent, or Firm*—Harpman & Harpman

[57] ABSTRACT

A storage and organizer holder for detachable socket wrench heads of the polygonal socket types, the holder including a base member with several parallel rows of dove-tailed slots in which a plurality of cross sectionally square posts having dove-tailed shaped downward extensions are slidably and frictionally engaged. The dimensions of the cross sectionally square posts are varied so as to correspond to the standard drive dimensions of the socket wrench sets and are preferably positioned in the dove-tailed slots of the base member of the holder in groups corresponding with each of the different sizes of the standard drive dimensions of the socket wrench sets. The holder is preferably formed of an extruded or molded synthetic resin, the synthetic resin being sufficiently resilient to hold the dove-tailed downward extensions of the cross sectionally square posts in desired position while at the same time permitting them to be moved to such position. Polyvinyl chloride is a suitable synthetic resin. A secondary base is preferably bonded to the base member of the holder so as to prevent undue distortion of the base holder and if desired end caps may be attached to the opposite ends of the holder.

1 Claim, 1 Drawing Sheet

HOLDER FOR SOCKET WRENCH HEADS

BACKGROUND OF THE INVENTION

1. Technical Field

This invention relates to holders for socket wrench set heads which comprise the fittings of detachable socket wrench sets of the polygonal socket type.

2. Description of the Prior Art

U.S. Pat. No. 1,712,473 illustrates an elongated flat bar having a plurality of solid posts secured to one side of the bar for receiving the socket wrench heads. The posts are provided with transverse bores in which a pair of balls spaced by a coil spring are positioned to provide frictional contact with the socket wrench heads.

U.S. Pat. No. 3,405,377 discloses a holder having an elongated body member with a plurality of openings formed therein and a pair of magnets positioned in the lower portion of each of the openings so that socket wrench heads positioned in the openings will be held therein by magnetic attraction.

An alternate form of the invention positions an elongated magnet in the lower portion of the body member so as to extend across each of the openings therein.

U.S. Pat. No. 3,726,393 discloses a base having a plurality of openings therein in which posts of a tiered shape are positioned for receiving the socket wrench head. The disclosure contemplates positioning the tiered posts or their equivalents in fixed relation in the openings and/or shaping the same as integral portions of the base.

U.S. Pat. No. 4,337,860 discloses an elongated base member having a plurality of openings spaced longitudinally therein in which a plurality of cylindrical posts are engaged, the posts being of a size and shape to be removably inserted in the holes and the posts forming cross sectionally circular surfaces engageable in the squared openings in the socket wrench heads. The heads of each of the cylindrical posts are substantially larger than their downwardly extending cylindrical bases which engage the openings so that a plurality of the posts may be stacked vertically in inter-engaging relation.

The present invention differs from the prior art structures in that it discloses the holder for the socket wrench heads as comprising a resilient body member having spaced parallel dove-tailed shaped slots extending longitudinally thereof in which a plurality of cross sectionally square posts having dove-tailed downward extensions are positioned in desirably spaced relation to one another by sliding the same in the dove-tailed slots with sufficient effort to overcome the friction imparted by the opposed sides of the dove-tailed shaped slots which are sized with respect to width and depth to require slight distortion of the base of the holder in which slots are formed to permit the dove-tailed posts to be moved therein whereby the posts are secured in desired position by the resilient characteristic of the base of the holder. Alternately the posts and their dove-tailed extensions in particular may be formed of sufficiently resilient synthetic resin in dimensions slightly larger than the dimensions of the dove-tailed slots in the holder so that while they can be slid into desired positions, their resilient characteristics will secure them in the desired positions.

SUMMARY OF THE INVENTION

A holder for socket wrench heads comprising an elongated base member having a plurality of longitudinally extending transversely spaced parallel dove-tailed grooves therein and a plurality of cross sectionally square posts having dove-tailed downward extensions formed integrally therewith for registry with the dove-tailed grooves in the holder. The dimensions of the cross sectionally square posts are one-quarter inch, three-eighths inch and one-half inch, respectively, which correspond with the size of the standard drive dimensions of detachable socket wrench sets. The elongated base member is preferably formed of a resilient synthetic resin, such as polyvinyl chloride, so that the inherent resiliency of the elongated base member and the dove-tailed grooves therein as well as the inherent resiliency of the cross sectionally square posts with their dove-tailed downward extensions will permit sliding engagement and act to hold the cross sectionally square posts in desired position in the grooves of the base member.

DESCRIPTION OF THE PREFERRED EMBODIMENT

Figure 1:
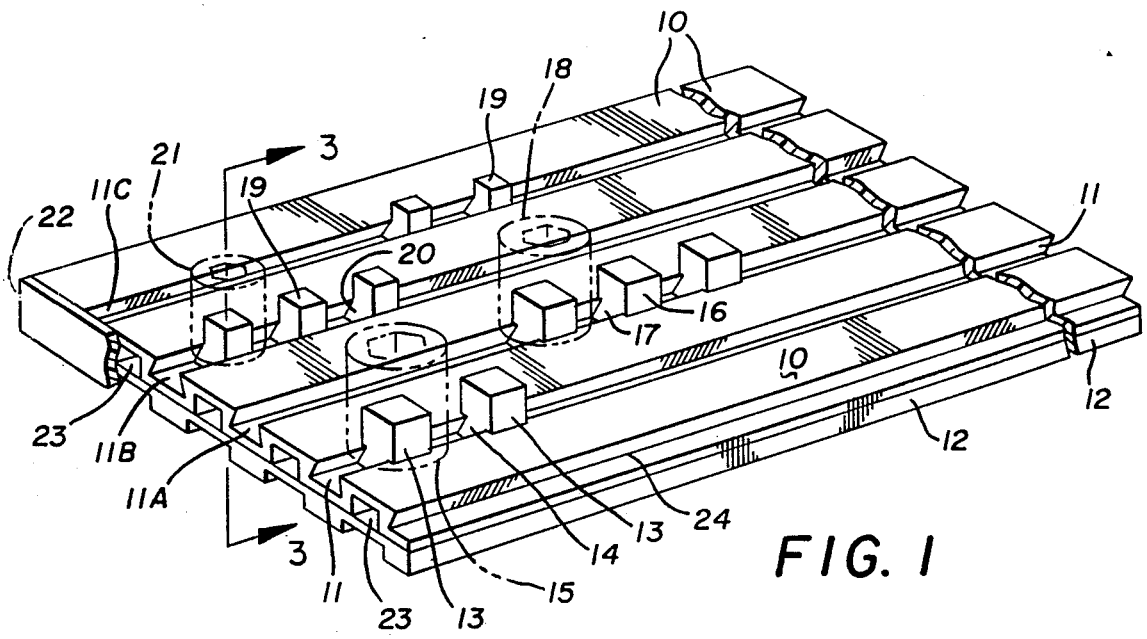
FIG. 1 is a perspective elevation with parts broken away and parts in cross section of a holder for socket wrench heads. Broken lines illustrate socket wrench heads positioned thereon.

By referring to the drawings and FIG. 1 in particular it will be seen that the holder for socket wrench heads provides a convenient storage and organizer for such socket wrench heads which as known in the art are cylindrical members having squared openings in one end and a multiple sided polygonal opening in the other end.

In FIG. 1 of the drawings, the holder comprises an elongated base member 10 having several longitudinally extending transversely spaced parallel dove-tailed grooves 11 formed in the upper surface thereof. The elongated base member 10 preferably has a secondary base member 12 bonded to the lower surface thereof so as to control the degree of flexibility of the holder. Both the elongated base member 10 and the secondary base member 12 are preferably formed of a resilient and/or distortable synthetic resin that may be extruded and/or injection molded.

As illustrated in FIG. 1 of the drawings, two of a plurality of cross sectionally square posts 13, each having a dove-tailed downward extension 14 thereon are shown positioned in the dove-tailed groove 11, each of the cross sectionally square posts 13 has a one-half inch dimension on each side and height so as to be engageable in a squared opening of registrable size formed in one end of each of the conventional socket wrench heads, one of which is illustrated in broken lines in FIG. 1 of the drawings and indicated by the numeral 15.

It will be understood that a plurality of such one-half inch square posts 13 are provided to accommodate as many of the socket wrench heads as the user desires, which heads are easily accommodated in the dove-tailed grooves 11 in the elongated base member 10 of the invention. Three of a plurality of different sized cross sectionally square posts 16 are illustrated as being positioned in one of the elongated grooves 11A and each of the cross sectionally square posts 16 has a dove-tailed downward extension 17. The dimensions of the side and the height of the cross sectionally square posts 16 is three-eighths inch and adapted to register in a squared opening in a socket wrench head 18, one of which is shown in broken lines in FIG. 1 of the drawings.

Still referring to FIG. 1, it will be seen that three of a plurality of cross sectionally square posts 19 are shown positioned in a longitudinally extending groove 11B in the elongated base member 10 of the holder, each of the cross sectionally square posts 19 having a dove-tailed downward extension 20 integrally formed therewith. The dimension of the cross sectionally square sides and height of the cross sectionally square post 19 are one-quarter inch and thereby adapted to register in a squared opening of registering size in a socket wrench head 21 as illustrated in broken lines in FIGS. 1 and 3 of the drawings.

Figure 2:
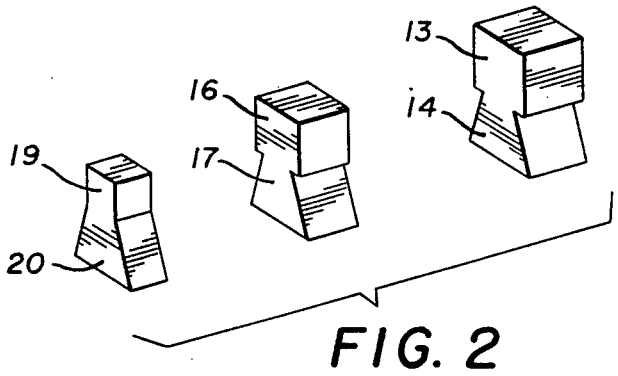
FIG. 2 is a composite perspective view of three cross sectionally square posts representing three groups of such posts forming part of the holder of FIG. 1.

In FIG. 2 of the drawings, one of each of the square posts 13, 16 and 19 may be seen in perspective and by referring thereto the respective sizes of the squared posts from left to right are respectively a quarter inch, three-eighths inch, and one-half inch which are the sizes of the posts of the driving members of the socket wrench with which the socket wrench heads are employed.

Figure 3:
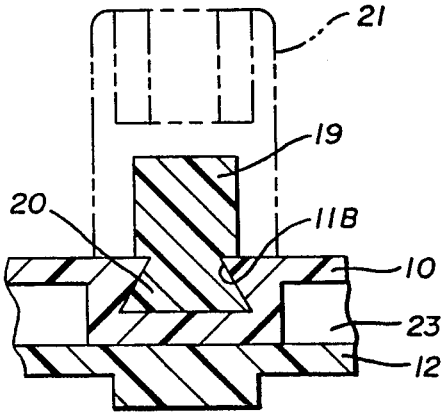
FIG. 3 is an enlarged section on line 3—3 of FIG. 1.

By referring now to FIG. 3 of the drawings, it will be seen that a broken line illustration of the socket wrench head 21 of FIG. 1 of the drawings is shown in enlarged detail and those skilled in the art will observe that such socket wrench heads are usually formed of hardened steel and provided with a chrome coating or the like. Such socket wrench heads are supplied with commercial socket wrench sets in which the driving elements are of three sizes and the socket wrench heads are accordingly provided with squared openings matching the three sizes of the driving elements. The socket wrench sets used by mechanics include a substantial number of the socket wrench heads with various sized configurations in the ends thereof opposite the squared openings so that they can be engaged on various sized nuts and bolts and the like with which the socket wrenches are being used. A major problem faced by mechanics and other uses of socket wrench sets is organization and/or storage of the different socket wrench heads as evidenced by the attempts to provide simple and workable holders for the socket wrench heads as seen for example in the prior art hereinbefore referred to.

The prior art devices have generally failed in providing an adequate number of devices for holding and organizing the socket wrench heads and more importantly they have generally failed in securing the socket wrench heads in desired location. This particular problem is solved by the present invention wherein the elongated base member 10 with the longitudinally extending transversely spaced parallel dove-tailed grooves 11 therein are formed of a synthetic resin having a known degree of resilience and deformability and wherein the cross sectionally squared posts 13, 16 and 19 and their dove-tailed downwardly extending dove-tailed portions 14, 17 and 20 respectively are formed of a synthetic resin preferably having a known degree of resilience and deformability different from that of the resin from which the elongated base member 10 is formed. Polyvinyl chloride with various fillers is representative of one of a plurality of synthetic resins capable of extrusion and molding and wherein the degree of resiliency and deformability is easily predetermined.

By referring again to FIG. 1 of the drawings, it will be seen that a portion of an end cap 22 is shown at the left end of the elongated base member 10 and secondary base 12 and attached thereto in either a fixed or removable manner, such as by bonding and/or providing projections on the inner side of the end cap 22 registrable with the openings formed by the longitudinal channels 23 in the lower surface of the elongated base member 10 between each of the longitudinally extending transversely spaced parallel dove-tailed grooves 11, 11A, 11B, 11C, etc.

It will also be observed that a configuration 24 comprising half of a dove-tailed groove is formed in the longitudinal edge of the elongated base member 10 in the front side of the same as illustrated in FIG. 1 of the drawings.

Mechanics having a great many of the socket wrench heads can therefore place a pair of the devices as seen in FIG. 1 of the drawings in edge to edge relation so that corresponding configurations 24 when placed together will form an additional dove-tailed groove along with the additional dove-tailed grooves in the second device positioned thereagainst.

It will thus be seen that the structure herein disclosed forms a holder for socket wrench heads that is inherently resilient regardless of the material of which it is formed due to the configuration of the longitudinally extending dove-tailed grooves 11–11C and the positioning of the intermediate longitudinally extending channels 23 whereby the resulting structure with or without the secondary base 12 and/or the end caps 22 can be bowed transversely to expand the dove-tailed channels 11–11C whereby the dove-tailed downward extensions 14, 17 and 20 of the cross sectionally squared posts 13, 16 and 19, respectively, can be positioned in the dove-tailed grooves and held thereby when the holder is allowed to return to its normal formed shape.

Although the preferred construction comprises molded and/or extruded synthetic resin, such as polyvinyl chloride or the like, the device of the invention can be formed of other materials so as to retain its novel qualities.

Although but one embodiment of the present invention has been illustrated and described, it will be apparent to those skilled in the art that various changes and modifications may be made therein without departing from the spirit of the invention and having thus described my invention, what I claim is:

1. An improved apparatus for organizing and holding individual socket wrench heads of tools having sets of said socket wrench heads, said heads having a squared opening in one end adapted to engage a drive member and having the other end shaped to engage nuts and bolt heads, the improved apparatus comprising: a base member in the form of a flat body having upper and lower surfaces, a plurality of transversely parallel dove-tailed grooves in said upper surface thereof and a plurality of cross sectionally square posts, each having a dove-tailed downward extension adapted to fit into said dove-tailed grooves in said base member and said cross sectionally square posts fitting with frictional engagement in said squared openings in said socket wrench heads, channels formed in said lower surface of said flat body intermediate said spaced parallel dove-tailed grooves whereby the base member may be temporarily bowed transversely in a direction to increase the width of said dove-tailed grooves to permit the downturned extensions on the cross sectionally square posts to be movably placed therein.

* * * * *